US010602572B2

(12) United States Patent
Takimoto et al.

(10) Patent No.: US 10,602,572 B2
(45) Date of Patent: Mar. 24, 2020

(54) COOKING DEVICE

(71) Applicant: SHARP KABUSHIKI KAISHA, Sakai, Osaka (JP)

(72) Inventors: Kazutoshi Takimoto, Sakai (JP); Tadanori Sugimura, Sakai (JP); Akihiro Okazaki, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 352 days.

(21) Appl. No.: 15/533,732

(22) PCT Filed: Jan. 6, 2016

(86) PCT No.: PCT/JP2016/050226
§ 371 (c)(1),
(2) Date: Jun. 7, 2017

(87) PCT Pub. No.: WO2016/121431
PCT Pub. Date: Aug. 4, 2016

(65) Prior Publication Data

US 2017/0332447 A1 Nov. 16, 2017

(30) Foreign Application Priority Data

Jan. 28, 2015 (JP) ..... 2015-014806

(51) Int. Cl.
*H05B 6/64* (2006.01)
*H05B 6/66* (2006.01)
*H05B 6/68* (2006.01)

(52) U.S. Cl.
CPC ..... *H05B 6/668* (2013.01); *H05B 6/6435* (2013.01); *H05B 6/6479* (2013.01); *H05B 6/687* (2013.01)

(58) Field of Classification Search
CPC .... H05B 6/6435; H05B 6/687; H05B 6/6479; H05B 6/668
(Continued)

(56) References Cited

U.S. PATENT DOCUMENTS

2008/0105673 A1 5/2008 Ikeda et al.
2011/0303652 A1* 12/2011 Sano ..... F24C 7/082 219/622
2016/0359325 A1* 12/2016 Kawata ..... G16H 40/67

FOREIGN PATENT DOCUMENTS

CN 102245972 A 11/2011
JP 2002-333145 A 11/2002
(Continued)

OTHER PUBLICATIONS

Translation of JP2009124895, Input/Output device of an apparatus, dated Apr. 6, 2009, European Patent Office (Year: 2009).*
(Continued)

*Primary Examiner* — Quang T Van
(74) *Attorney, Agent, or Firm* — Birch, Stewart, Kolasch & Birch, LLP

(57) ABSTRACT

Provided is a cooking device capable of being provided with a radio communication device so that the radio communication device establishes a satisfactory communication, instead of (i) further providing any special configuration in which the radio communication device is provided and (ii) making any change in structure of the cooking device. According to a cooking device (1), a space for providing a radio communication adapter is secured in a frame (3*b*) of a door (3) or in a circuit storing section (50), made of a nonmetal, which is configured to store a driving circuit of a display operation section (5).

5 Claims, 6 Drawing Sheets

(58) Field of Classification Search
USPC ..... 219/679, 714, 710, 702, 713, 729, 741, 219/743, 748, 737, 738, 711, 716, 734, 219/736, 506, 685
See application file for complete search history.

(56) References Cited

FOREIGN PATENT DOCUMENTS

| | | | |
|---|---|---|---|
| JP | 2003-227615 | A | 8/2003 |
| JP | 2005-260891 | A | 9/2005 |
| JP | 2007-3139 | A | 1/2007 |
| JP | 2009-124895 | A | 6/2009 |
| JP | 4469513 | B2 | 5/2010 |
| JP | 2013-21500 | A | 1/2013 |
| JP | 2014-35127 | A | 2/2014 |
| JP | 2014-235838 | A | 12/2014 |
| WO | WO 2006/048964 | A1 | 5/2016 |

OTHER PUBLICATIONS

Translation of JP20070033139, a Heating Cooker, dated Nov. 1, 2007, European Patent Office (Year: 2007).*

* cited by examiner

COOKING DEVICE

TECHNICAL FIELD

The present invention relates to a cooking device including a magnetron, the cooking device being to be provided with a radio communication device capable of establishing an external communication.

BACKGROUND ART

Recently, a network home appliance system including a home appliance that has a radio communication function, a so-called network home appliance has been in widespread use. The network home appliance system enables the network home appliance to communicate with communication terminals such as a tablet terminal and a smart phone via a communication network. With the communication terminals, a user can remotely control the network home appliance, and can find an operating state of the network home appliance.

One of such network home appliances is a cooking device including a magnetron. Cooking with a magnetron utilizes a so-called microwave oven function of generating a microwave. The cooking device including the magnetron has a side surface made of a metal housing so that a microwave is shielded. In a case where a radio communication device (radio communication adapter) is provided in a region covered with the metal housing, a communication radio wave is shielded. This causes a communication error such as reduction in communication distance. In order to secure communication of the radio communication device, for example, a housing is provided with a separate section, made of a resin, which is configured to store the radio communication device (see Patent Literature 1), or a communication antenna is provided in a leg part made of a resin (see Patent Literature 2).

CITATION LIST

Patent Literature

[Patent Literature 1]
Japanese Patent Application Publication Tokukai No. 2005-260891 (Publication date: Sep. 22, 2005)
[Patent Literature 2]
Specification of Japanese Patent No. 4469513 (Registration date: Mar. 5, 2010)

SUMMARY OF INVENTION

Technical Problem

As described above, a conventional cooking device including a magnetron necessitates (i) being provided with a separate section, made of a resin, which is configured to store a radio communication device or (ii) changing its structure, in order to secure communication of the radio communication device. This leads to increase in the number of production processes, and rise in cost.

The present invention was made to address the problems, and an object of the present invention is to provide a cooking device capable of being provided with a radio communication device so that the radio communication device establishes a satisfactory communication, instead of (i) further providing any special configuration in which the cooking device is provided with the radio communication device and (ii) making any change in structure of the cooking device.

Solution to Problem

In order to attain the object, a cooking device in accordance with an aspect of the present invention includes: a magnetron; a heating chamber in which an object to be cooked is to be put; a door section, provided so that the heating chamber is opened and closed, which has a window section and a nonmetal frame section which surrounds the window section; and a display operation section configured to carry out display and accept an operation, a space for providing a radio communication device that establishes an external communication being secured in the nonmetal frame section or in a circuit storing section, made of a nonmetal, which is configured to store a driving circuit of the display operation section.

A cooking device in accordance with an aspect of the present invention includes: a magnetron; a heating chamber in which an object to be cooked is to be put; a door section, provided so that the heating chamber is opened and closed, which has a window section and a nonmetal frame section which surrounds the window section; a display operation section configured to carry out display and accept an operation; a steam generator configured to generate steam; and a water reservoir, mainly made of a nonmetal, which is (i) a container configured to store water to be supplied to the steam generator and (ii) detachably provided from the cooking device, a space for providing a radio communication device that establishes an external communication being secured (i) in the nonmetal frame section, (ii) in a circuit storing section, made of a nonmetal, which is configured to store a driving circuit of the display operation section, or (iii) in contact with the water reservoir.

Advantageous Effects of Invention

An aspect of the present invention brings about an effect of providing a cooking device capable of being provided with a radio communication device so that the radio communication device establishes a satisfactory communication, instead of (i) further providing any special configuration in which the cooking device is provided with the radio communication device and (ii) making any change in structure of the cooking device.

Figure 4:
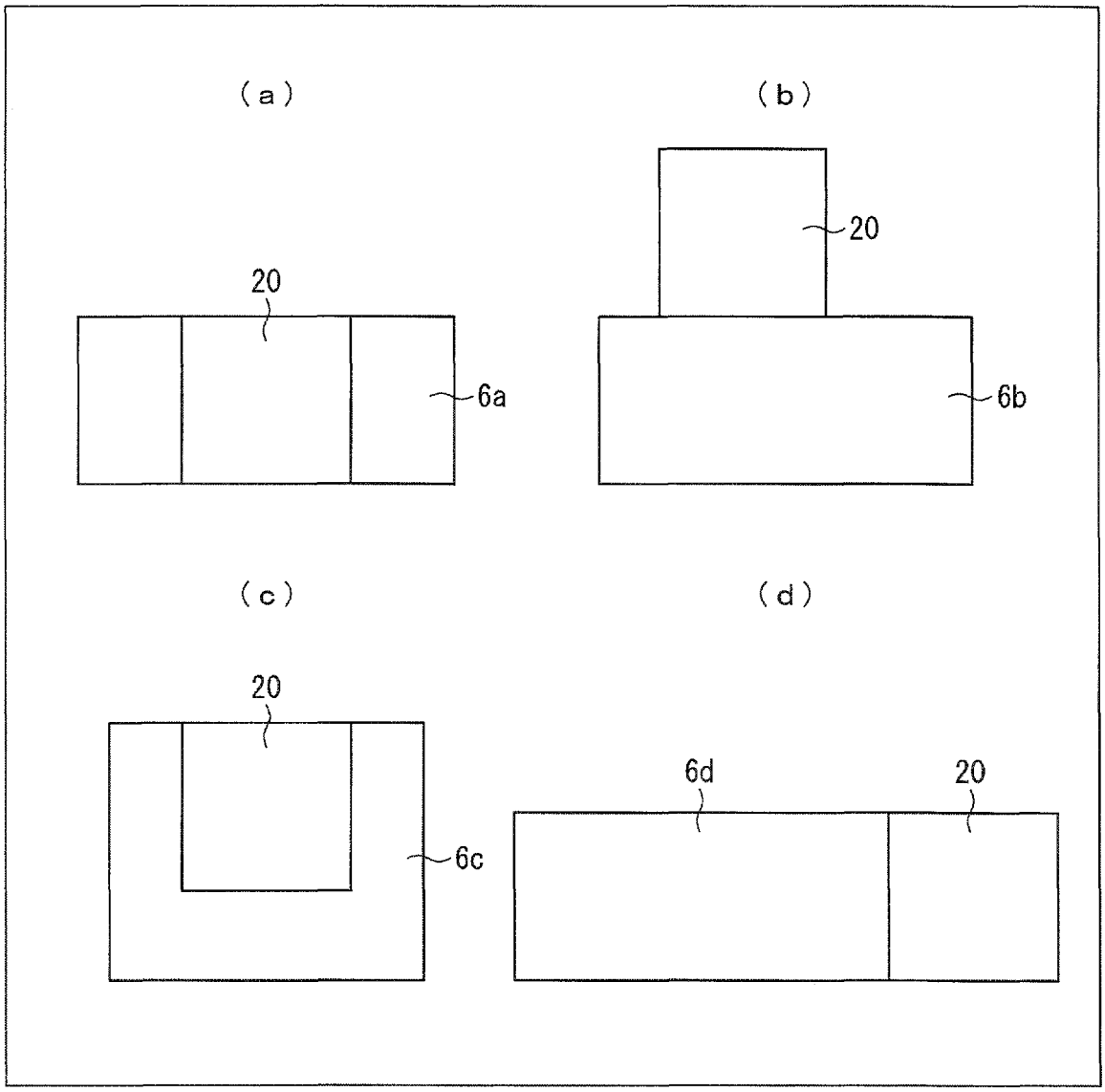

(a) through (d) of FIG. 4 are views each illustrating a corresponding example of how a radio communication adapter and a water tank are provided in the cooking device in accordance with Embodiment 3 of the present invention.

Figure 5:
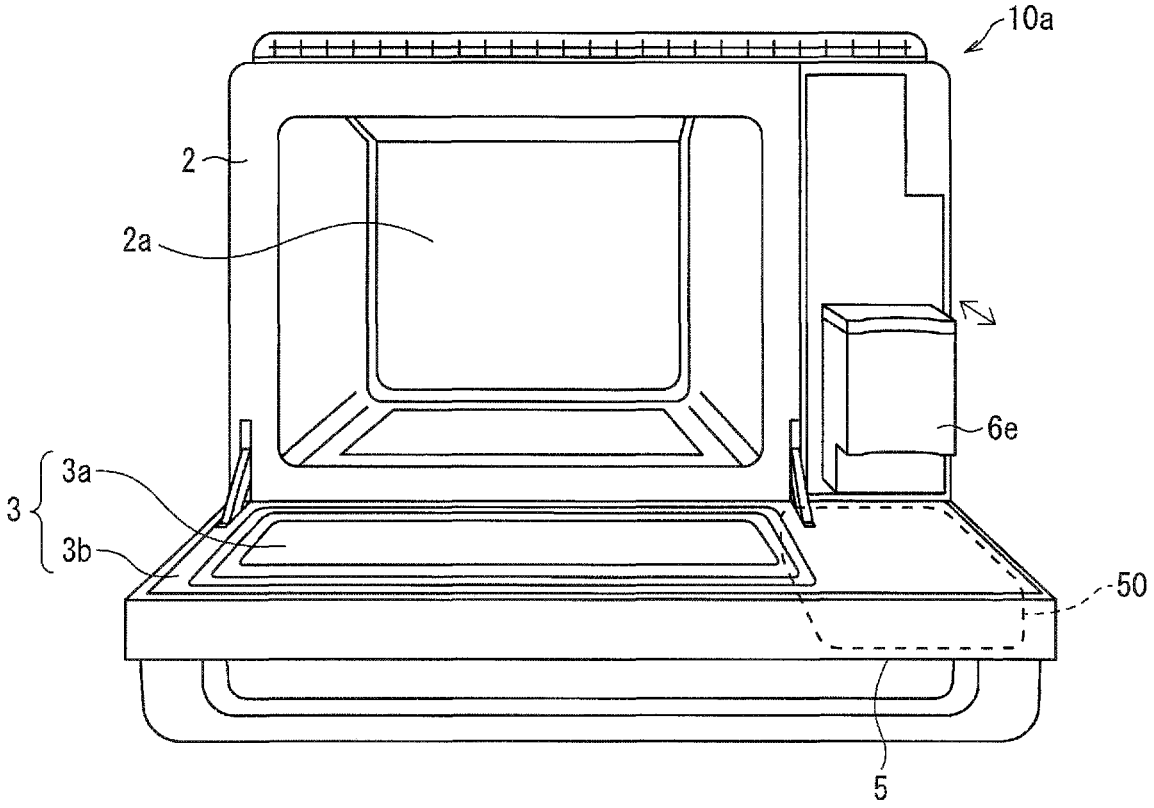

FIG. 5 is a front view illustrating a state where a door of a cooking device in accordance with Embodiment 4 of the present invention is opened.

Figure 6:
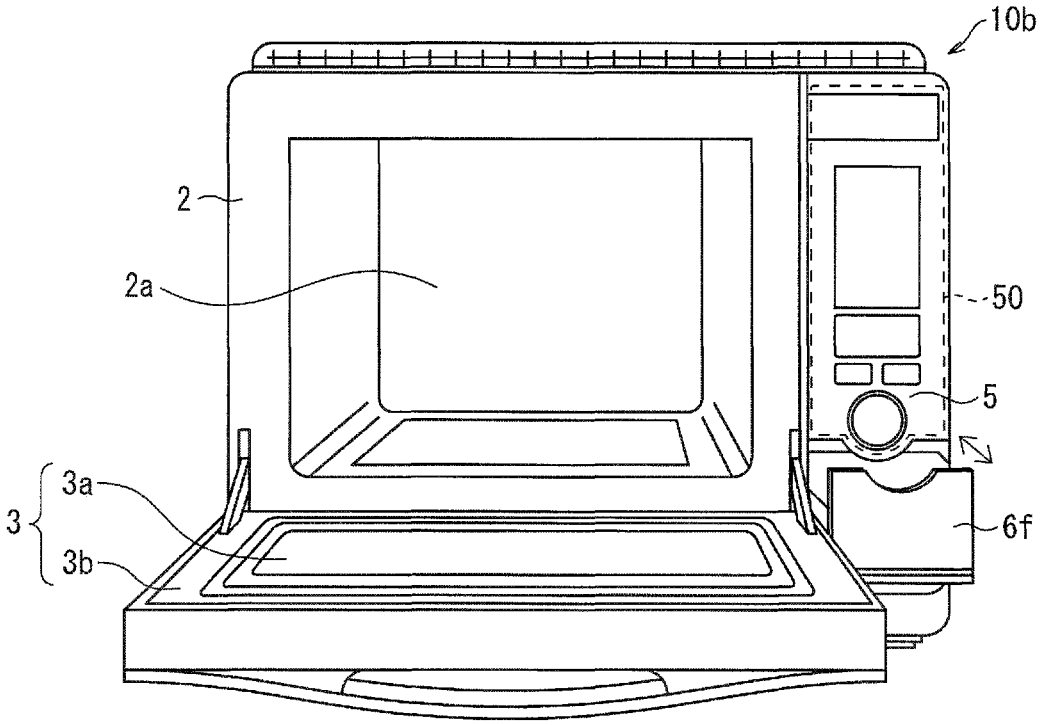

FIG. 6 is a front view illustrating a state where a door of another cooking device in accordance with Embodiment 5 of the present invention is opened.

DESCRIPTION OF EMBODIMENTS

[Embodiment 1]

Figure 1:
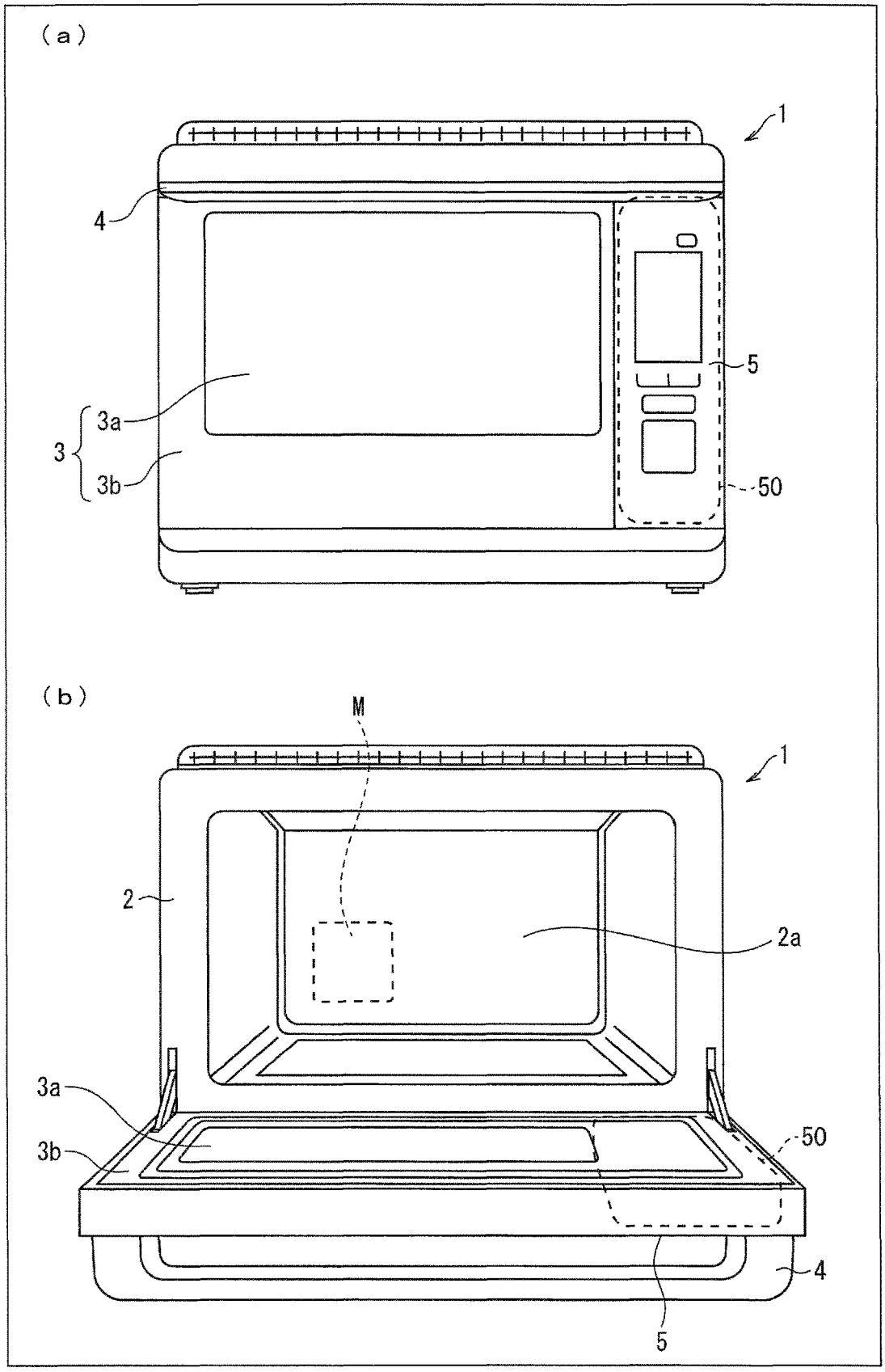
FIG. 1 is a front view illustrating a cooking device in accordance with Embodiment 1 of the present invention. (a) of FIG. 1 illustrates a state where a door is closed, and (b) of FIG. 1 illustrates a state where the door is opened.

The following description will discuss Embodiment 1 of the present invention in detail with reference to FIG. 1.

FIG. 1 is a front view illustrating a cooking device 1 of Embodiment 1. (a) of FIG. 1 illustrates a state where a door (door section) 3 is closed, and (b) of FIG. 1 illustrates a state where the door 3 is opened. The cooking device 1 includes a magnetron M that generates a microwave, and cooks by use of a microwave oven. The cooking device 1 can further have, for example, an oven cooking function in addition to a microwave cooking function. Note, however, that, in Embodiment 1, cooking will be all done by use of the function of the microwave oven unless otherwise noted.

As illustrated in FIG. 1, the cooking device 1 includes (i) a casing 2 in the shape of a rectangular parallelepiped and (ii) the door 3. A space, created by the casing 2, serves as a heating chamber 2*a* in which an object to be cooked is to be put. Note that the magnetron M is provided in the casing 2 (the magnetron M is provided, for example, on a side opposite to a side on which the door 3 is provided so that the door 3 and the magnetron M face via the heating chamber 2*a*).

The door 3 has (i) a window (window section) 3*a* provided so as to face the heating chamber 2*a* and (ii) a frame (frame section) 3*b* which surrounds the window 3*a*. A heat-resistant glass or a heat-resistant transparent resin is fitted in the window 3*a* so that the heating chamber 2*a* can be looked in through the window 3*a*.

The frame 3*b* is made of a nonmetal material, for example, a resin. The door 3 is rotatably provided substantially about its lower end side so that the heating chamber 2*a* is opened and closed. A handle 4 is provided on an upper side of the door 3 so as to help a user open and close the door 3. In Embodiment 1, the door 3 is rotatably provided substantially about the lower end side of the door 3 so as to be opened and closed. Embodiment 3 is, however, not limited as such. Alternatively, the door 3 can be rotatably provided about a left or right end side of the door 3 so as to be opened and closed.

There is formed a shielding member on a surface of the door 3 which surface faces the heating chamber 2*a* so that the shielding member covers an entrance of the heating chamber 2*a*.

The cooking device 1 further includes a display operation section 5 which is configured to (i) display various kinds of information concerning the cooking device 1 and (ii) accept an operation conducted to the cooking device 1. The display operation section 5 can be configured so as to function, for example, as a touch panel. The display operation section 5 can further include a dial and/or a button.

A driving circuit of the display operation section 5 is stored in a circuit storing section 50 made of a nonmetal. The circuit storing section 50 is provided with a cooling fan (not illustrated) so that an influence of heat generated due to cooking is reduced. The circuit storing section 50 is thus designed to lower generated temperature. The circuit storing section 50 is provided in the frame 3*b* of the door 3 (see FIG. 1). In Embodiment 1, the display operation section 5 and the door 3 are integrally provided. It can also be said that the circuit storing section 50 and the door 3 are integrally provided.

According to the cooking device 1, there is secured, in the frame 3*b* or in the circuit storing section 50, a space for providing a radio communication adapter (radio communication device) via which an external communication is established. Note that FIG. 1 illustrates a state where no radio communication adapter is provided in the cooking device 1. FIG. 1 thus illustrates no radio communication adapter.

The door 3 and the display operation section 5 are each made of a nonmetal material. According to a general cooking device including a magnetron, a door and a display operation section are each covered with a nonmetal material for the sake of suppressing rise in temperature. This is because a user directly touches the door and the display operation section of the cooking device. As such, according to a typical configuration of the cooking device, (i) a frame of the door is made of a nonmetal material or (ii) a circuit storing section configured to store a driving circuit of the display operation section is made of a nonmetal material. This allows the cooking device 1 to secure, in a region covered with a nonmetal member, the space for providing the radio communication adapter, instead of (i) further providing any special configuration to the typical configuration of the cooking device including the magnetron and (ii) making any change in structure of the cooking device 1.

In particular, the circuit storing section 50 is provided with the cooling fan. It is therefore possible for the radio communication adapter to be less affected by heat, by securing the space in the circuit storing section 50.

As is clear from the above, the cooking device 1 allows the radio communication adapter to establish a satisfactory communication, instead of (i) further providing any special configuration in which the radio communication adapter is provided and (ii) making any change in structure of the cooking device 1. The radio communication adapter, in a case of being provided in the space, is not covered with any metal, and it is difficult for the radio communication adapter to be affected by heat. The radio communication adapter can therefore establish a satisfactory communication.

By providing the radio communication adapter in the space, the cooking device 1 functions as a so-called network home appliance that is connected to an external communication network. Note that a publicly-known radio communication adapter can be employed as the radio communication adapter. For example, a device, in which a radio communication circuit and an antenna are integrally provided, can be employed as the radio communication adapter.

The description has discussed the cooking device 1 including the magnetron. The configuration, in which the radio communication adapter is provided in the frame of the door or in the circuit storing section of the display operation section, is applicable to a cooking device, including no magnetron, such as an oven or a toaster oven.

[Embodiment 2]

Figure 2:
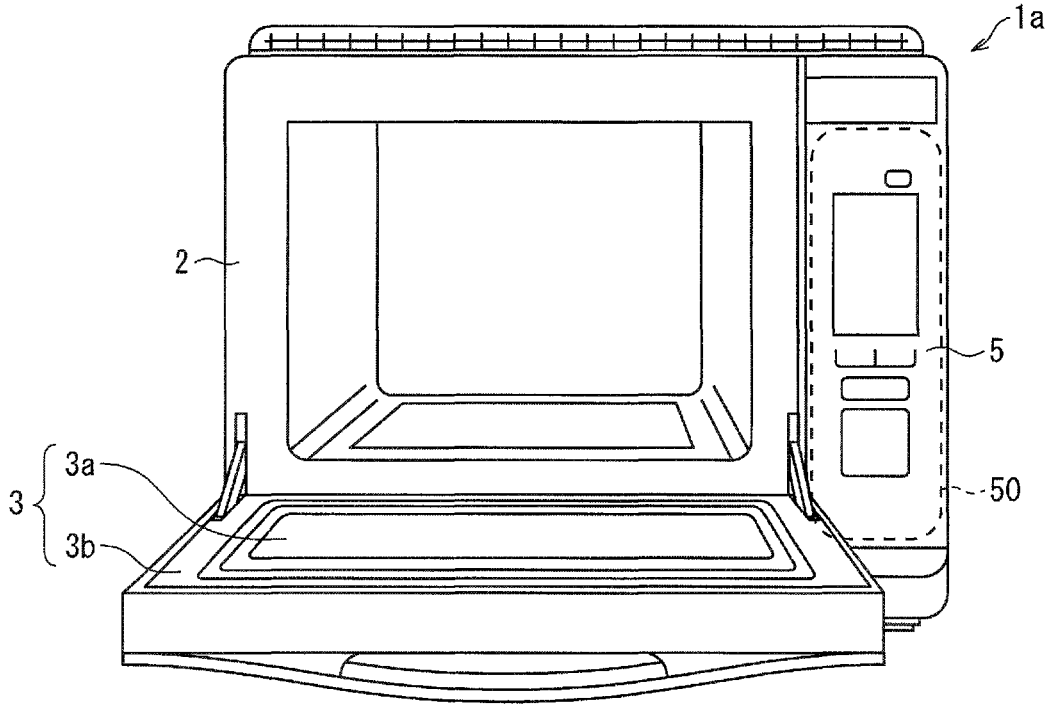
FIG. 2 is a front view illustrating a state where a door of a cooking device in accordance with Embodiment 2 of the present invention is opened.

The following description will discuss Embodiment 2 of the present invention with reference to FIG. 2. For convenience, identical reference numerals are given to members having respective functions identical to those of the members described in Embodiment 1, and descriptions of such members are omitted in Embodiment 2. FIG. 2 is a front view illustrating a state where a door 3 of a cooking device 1*a* of Embodiment 2 is opened.

Figure 3:
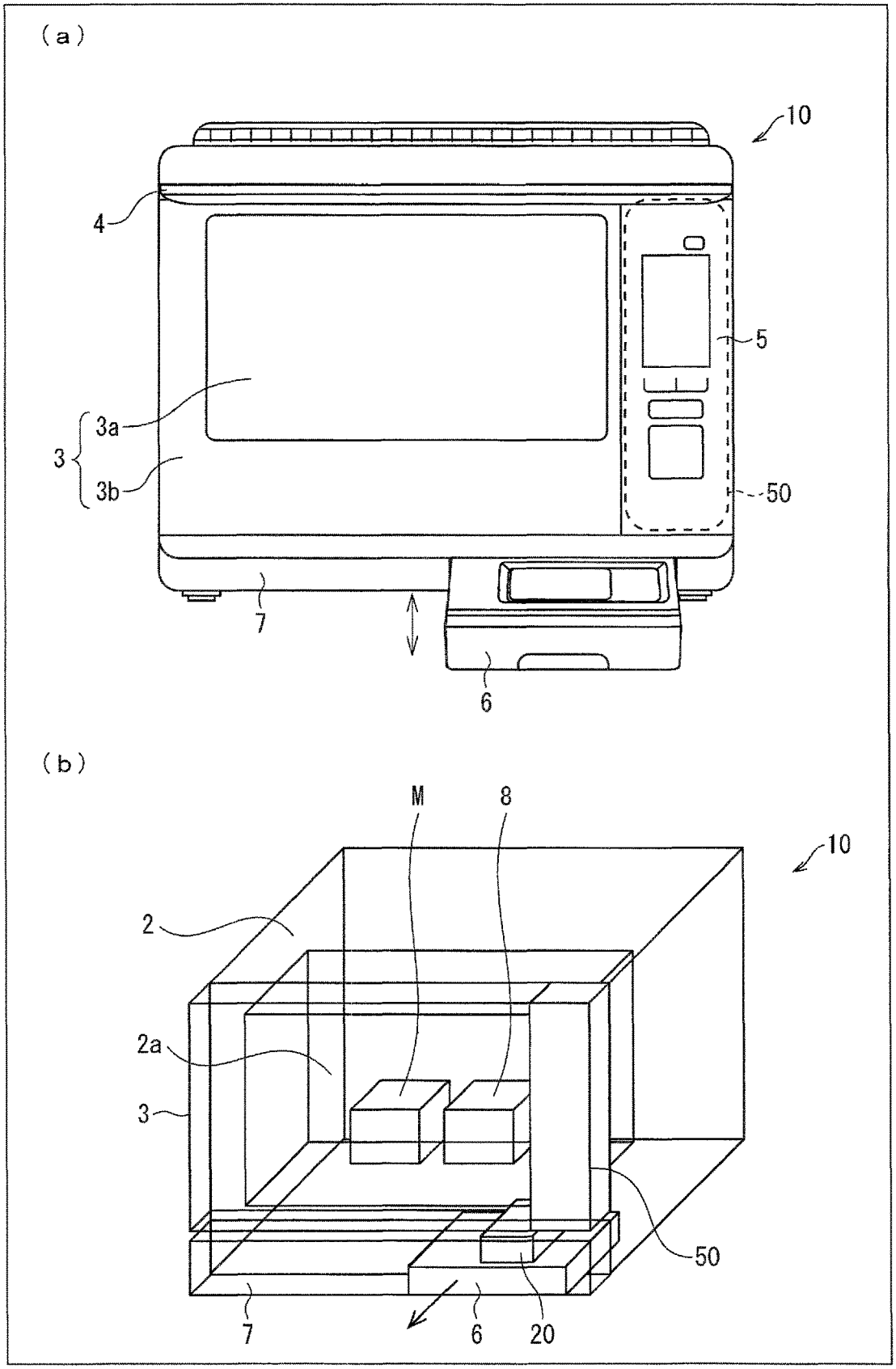
FIG. 3 is a view illustrating a cooking device in accordance with Embodiment 3 of the present invention. (a) of FIG. 3 illustrates a front view, and (b) of FIG. 3 illustrates a simplified perspective view.

In Embodiment 1, the display operation section 5 and the door 3 are integrally provided, whereas, in Embodiment 2, a display operation section 5 and the door 3 are not integrally provided but the display operation section 5 is attached to a casing 2 (see FIG. 3).

According to the cooking device 1*a*, there is secured, in a frame 3*b* or in a circuit storing section 50, a space for providing a radio communication adapter via which an external communication is established. Similar to the cooking device 1, the cooking device 1*a* allows the radio communication adapter to establish a satisfactory communication, instead of (i) further providing any special configuration in which the radio communication adapter is provided and (ii) making any change in structure of the cooking device 1*a*.

[Embodiment 3]

The following description will discuss Embodiment 3 of the present invention with reference to FIGS. 3 and 4. For convenience, identical reference numerals are given to members having respective functions identical to those of the members described in Embodiments 1 and 2, and descriptions of such members are omitted in Embodiment 3.

FIG. 3 is a view illustrating a cooking device 10 of Embodiment 3. (a) of FIG. 3 illustrates a front view, and (b) of FIG. 3 illustrates a simplified perspective view. Note that this perspective view illustrates all components of the cooking device 10 in the shape of a rectangular parallelepiped.

In addition to the configuration and function of the cooking device 1 described in Embodiment 1, the cooking device 10 of Embodiment 3 further includes a steam generator 8 (see (b) of FIG. 3) and has a function of oven cooking by use of steam generated by the steam generator 8. Note that FIG. 3 illustrates no heating device, such as a heater, which realizes the function of oven cooking.

The steam generator 8 is a device which heats water supplied from a water tank (water reservoir) 6 to generate saturated steam, and then supplies the saturated steam to a heating chamber 2*a*. Note that a drip box 7 is attachably and detachably provided, at a lower part of a casing 2, respectively to and from the casing 2. The drip box 7 collects steam which has been used to cook. The steam generator 8 and an oven cooking method using steam generated by the steam generator 8 can be each realized by a publicly-known technique.

The water tank 6 is a container configured to store water to be supplied to the steam generator 8. The water tank 6 is detachably provided from the cooking device 10 so that water is filled in the water tank 6. In Embodiment 3, the water tank 6 is made of a resin. Alternatively, the water tank 6 can be partially made of a metal or the water tank 6 can be made of only nonmetal, provided that the water tank 6 is mainly made of a nonmetal. Note that, in a case where a radio adapter is provided so as to be in contact with the water tank 6 as described later, a metal part of the water tank 6 is preferably formed and provided so as not to inhibit the radio adapter from establishing a communication.

In the vicinity of the water tank 6, there is provided a cooling fan (not illustrated) which cools down the water tank 6. The cooling fan, provided in the vicinity of the water tank 6, is used to reduce heat generated in the vicinity of the water tank 6. This prevents the water tank 6 from being, for example, deformed, deteriorated, or broken by the heat generated during cooking.

According to the cooking device 10 of Embodiment 3, there is secured, (i) in a frame 3*b*, (ii) in a circuit storing section 50, or (iii) in contact with the water tank 6, a space for providing a radio communication adapter via which an external communication is established. Note that the simplified perspective view ((b) of FIG. 3) of the cooking device 10 illustrates a state where a radio communication adapter 20 is provided in contact with the water tank 6. The radio communication adapter 20 is a publicly-known radio communication adapter in which a radio communication circuit and an antenna are integrally provided.

An effect, brought about by the cooking device 10 in which the space is secured in the frame 3*b* or in the circuit storing section 50, is similar to that brought about by the cooking device 1 of Embodiment 1.

As described above, the water tank 6 is (i) detachably provided from the cooking device 10 and (ii) mainly made of a nonmetal. In a case where the space is secured in contact with the water tank 6, the radio communication adapter provided in the space establishes an external communication via the water tank 6. Since water is supplied to the water tank 6, the temperature of the water tank 6 is low. In addition, a cooling fan or the like is usually provided around the water tank 6 so that the water tank 6 is less affected by heat generated during cooking. Namely, the water tank 6 is thus designed to lower the temperature. Accordingly, even in a case where the space is secured in contact with the water tank 6 mainly made of a nonmetal, it is possible for the radio communication adapter to be less affected by the metal and the heat.

Even in a case of a cooking device 10*a* including a steam generator 8 configured to generate steam, the radio communication adapter 20 can establish a satisfactory communication, instead of (i) further providing any special configuration in which the radio communication adapter 20 is provided and (ii) making any change in structure of the cooking device 10.

Note that, in a case where a space for providing a radio communication adapter is secured at a lower part of the water tank 6, a water leakage from the water tank 6 could adversely affect the radio communication adapter. In contrast, since the space for providing the radio communication adapter is secured at an upper part of the water tank 6 (see (b) of FIG. 3), such a water leakage will never adversely affect the radio communication adapter. Moreover, a lower part of the heating chamber 2*a* is more unlikely to be affected by heat than the other parts. It is therefore preferable to secure the space for providing the radio communication adapter, at the upper part of the water tank 6 and at the lower part of the heating chamber 2*a*.

The following description will discuss specific examples in each of which the space for providing the radio communication adapter is secured in contact with the water tank 6. (a) through (d) of FIG. 4 are views each illustrating, when viewed from above, a corresponding example of a positional relationship between the water tank 6 and the radio communication adapter 20.

In (b) of FIG. 4, the space for providing the radio communication adapter 20 is secured behind a water tank 6*b* (on a back side of the water tank 6*b*). In this case, the radio communication adapter 20 contacts with the water tank 6*b* behind the water tank 6*b*. In (c) of FIG. 4, the space for providing the radio communication adapter 20 is secured so as to be surrounded by a water tank 6*c*. In this case, the radio communication adapter 20 contacts with the water tank 6*c* in a space surrounded by the water tank 6*c*. In (d) of FIG. 4, the space for providing the radio communication adapter 20 is secured at a lateral part of a water tank 6*d*. In this case, the radio communication adapter 20 contacts with the water tank 6*d* on a side surface of the water tank 6*d*. In (a) of FIG. 4, the space for providing the radio communication adapter 20 is secured at an upper part of a water tank 6*a*. In this case, the radio communication adapter 20 contacts with the water tank 6*a* on an upper surface of the water tank 6*a*. The space for providing the radio communication adapter 20 is not limited to be secured as such, provided that it is secured so that the radio communication adapter 20 contacts with the water tank 6.

By being provided with the radio communication adapter 20, the cooking device 1 functions as a so-called network home appliance that is connected to an external communication network.

The cooking device 10 can be configured to cook with the use of superheated steam. With the configuration, a heater (not illustrated), for use in generating superheated steam, heats steam generated by the steam generator 8, so that superheated steam is generated. The superheated steam fills the heating chamber 2*a* and heats an object to be cooked.

Similar to the cooking device 1*a* of Embodiment 2, the cooking device 10 of Embodiment 3 can be configured such that a display operation section 5 is provided separately from a door 3. The cooking device 10 of Embodiment 3 can also be configured such that the door 3 rotates about a left or right end side of the door 3 to be opened and closed.

Note that the above description has discussed the cooking device 10 including a magnetron and the steam generator, but the present invention is not limited as such. The configuration, in which the space for providing the radio adapter is secured in the frame of the door or in the circuit storing section of the display operation section, is applicable to a cooking device, such as an oven, which includes a steam generator but no magnetron.

[Embodiments 4 and 5]

The following description will discuss Embodiments 4 and 5 of the present invention with reference to FIGS. 5 and 6. For convenience, identical reference numerals are given to members having respective functions identical to those of the members described in Embodiments 1 through 3, and descriptions of such members are omitted in Embodiments 4 and 5.

FIG. 5 is a front view illustrating a state where a door 3 of a cooking device 10*a* of Embodiment 4 is opened. FIG. 6 is a front view illustrating a state where a door 3 of a cooking device 10*b* of Embodiment 5 is opened.

The cooking device 10*a* is different from the cooking device 10 of Embodiment 3, in where a water tank 6*e* is provided. Except for the difference, the configuration of the cooking device 10*a* is identical to that of the cooking device 10 of Embodiment 3. The water tank 6*e* is made of a resin. The water tank 6*e* is provided at a lateral part of a heating chamber 2*a* so as to be detachable from the cooking device 10*a*.

According to the cooking device 10*b* of Embodiment 5, a display operation section 5 is attached to a casing 2 but the display operation section 5 and the door 3 are not integrally provided. Except for this configuration, the configuration of the cooking device 10*b* of Embodiment 5 is identical to that of the cooking device 10*a* of Embodiment 4. Similar to the water tank 6*e* of the cooking device 10*a*, a water tank 6*f* of the cooking device 10*b* of Embodiment 5 is provided at a lateral part of a heating chamber 2*a*.

According to the cooking device 10*a* and the cooking device 10*b*, there is secured, (i) in a frame 3*b*, (ii) in a circuit storing section 50, or (iii) in contact with the water tank 6*e* (6*f*), a space for providing a radio communication adapter via which an external communication is established. Similar to the cooking device 10, the cooking devices 10*a* and 10*b* each allow the radio communication adapter to establish a satisfactory communication, instead of (i) further providing any special configuration in which the radio communication adapter is provided and (ii) making any change in structures of the cooking devices 10*a* and 10*b*.

A cooking device (1) in accordance with Aspect 1 of the present invention is configured to include: a magnetron (M); a heating chamber (2*a*) in which an object to be cooked is to be put; a door section (door 3), provided so that the heating chamber is opened and closed, which has a window section (window 3*a*) and a nonmetal frame section (frame 3*b*) which surrounds the window section; and a display operation section (5) configured to carry out display and accept an operation, a space for providing a radio communication device that establishes an external communication being secured in the nonmetal frame section or in a circuit storing section, made of a nonmetal, which is configured to store a driving circuit of the display operation section.

According to the configuration, the space for providing the radio communication device is secured in the nonmetal frame section or in the circuit storing section, made of the nonmetal, which is configured to store the driving circuit of the display operation section. Here, in general, a door section and a display operation section are each covered with a nonmetal material for the sake of suppressing rise in temperature. This is because a user directly touches the door section and the display operation section. As such, according to a typical configuration of a cooking device including a magnetron, (i) a frame section of the door section is made of a nonmetal material or (ii) a driving circuit of the display operation section is made of a nonmetal material. In view of this, the configuration makes it possible to secure, in a region covered with a nonmetal member, a space for providing a radio communication device, instead of (i) further providing any special configuration to the typical configuration of the cooking device including the magnetron and (ii) making any change in structure of the cooking device.

In particular, the circuit storing section configured to store the driving circuit of the display operation section is provided with, for example, a cooling fan so that an influence of heat generated due to cooking is reduced. The circuit storing section is thus designed to lower the temperature. Accordingly, by securing the space in the circuit storing section, it is possible for the radio communication device to be less affected by the heat.

As is clear from the above, the configuration makes it possible to provide a cooking device capable of being provided with a radio communication device so that the radio communication device establishes a satisfactory communication, instead of (i) further providing any special configuration in which the cooking device is provided with the radio communication device and (ii) making any change in structure of the cooking device. The radio communication device, in a case of being provided in the space, is not covered with any metal, and it is difficult for the radio communication device to be affected by heat. The radio communication device can therefore establish a satisfactory communication.

A cooking device (10, 10*a*, 10*b*) in accordance with Aspect 2 of the present invention is configured to include: a magnetron (M); a heating chamber (2*s*) in which an object to be cooked is to be put; a door section (door 3), provided so that the heating chamber is opened and closed, which has a window section (window 3*a*) and a nonmetal frame section (frame 3*b*) which surrounds the window section; a display operation section (5) configured to carry out display and accept an operation; a steam generator (8) configured to generate steam; and a water reservoir (water tank 6), mainly made of a nonmetal, which is (i) a container configured to store water to be supplied to the steam generator and (ii) detachably provided from the cooking device, a space for providing a radio communication device that establishes an external communication being secured (i) in the nonmetal frame section, (ii) in a circuit storing section, made of a nonmetal, which is configured to store a driving circuit of the display operation section, or (iii) in contact with the water reservoir.

According to the configuration, the space for providing the radio communication device is secured (i) in the nonmetal frame section, (ii) in the circuit storing section, made of the nonmetal, which is configured to store the driving circuit of the display operation section or (iii) in contact with the water reservoir mainly made of the nonmetal. An effect brought about by securing the space in the nonmetal frame section or in the circuit storing section is similar to that brought about by the cooking device in accordance with Aspect 1 of the present invention.

According to the configuration, the water reservoir is (i) detachably provided from the cooking device and (ii) mainly made of a nonmetal. In a case where the space for providing the radio communication device is secured in contact with the water reservoir, the radio communication device provided in the space establishes an external communication via the water reservoir mainly made of a nonmetal. Since water is supplied to the water reservoir, the temperature of the water reservoir is low. In addition, a cooling fan or the like is usually provided around the water reservoir mainly made of a nonmetal so that the water reservoir is less affected by heat generated due to cooking. Namely, the water reservoir is thus designed to lower the temperature. Accordingly, even in a case where the space is secured in contact with the water reservoir mainly made of a nonmetal, it is possible for the radio communication device to be less affected by the metal and the heat.

As is clear from the above, the configuration makes it possible to provide a cooking device that includes not only a magnetron but also a steam generator configured to generate steam so that a radio communication device can establish a satisfactory communication, instead of (i) further providing any special configuration in which the radio communication device is provided and (ii) making any change in structure of the cooking device.

In Aspect 3 of the present invention, a cooking device is configured such that, in the cooking device in accordance with Aspect 2 of the present invention, the water reservoir is provided at a lower part of the heating chamber, and the space contacts with the water reservoir at an upper part of the water reservoir and at the lower part of the heating chamber.

In a case where a space for providing a radio communication device is secured at a lower part of a water reservoir, a water leakage from the water reservoir could adversely affect the radio communication device. In contrast, since the space for providing the radio communication device is secured at an upper part of the water reservoir, such a water leakage will never adversely affect the radio communication device. Moreover, a lower part of the heating chamber is more unlikely to be affected by heat than the other parts. As such, the configuration makes it possible to provide the radio communication device in a space which is more unlikely to be affected by water and heat.

In Aspect 4 of the present invention, a cooking device is configured such that, in the cooking device in accordance with any one of Aspects 1 through 3 of the present invention, the circuit storing section and the door section are integrally provided.

The configuration makes it possible to apply the present invention to a cooking device in which a circuit housing section and a door section are integrally provided.

In Aspect 5 of the present invention, a cooking device is configured such that, in the cooking device in accordance with any one of Aspects 1 through 4 of the present invention, the radio communication device is a device in which a radio communication circuit and an antenna are integrally provided.

Since the radio communication circuit and the antenna are integrally provided according to the configuration, the space for providing the radio communication device can be narrowed compared to a case where the radio communication circuit and the antenna are separately provided, and no influence is exerted on providing other components of the cooking device.

In Aspect 6 of the present invention, a cooking device is configured such that, in the cooking device in accordance with any one of Aspects 1 through 5 of the present invention, the radio communication device (radio communication adapter 20) is provided in the space, and the cooking device is connected to an external communication network via the radio communication device.

The configuration makes it possible to provide a cooking device capable of establishing a satisfactory external communication with a radio communication device.

The present invention encompasses a network home appliance system including (i) the cooking device in accordance with Aspect 6 and (ii) a communication terminal communicable with the radio communication device provided in the cooking device in accordance with Aspect 6.

The present invention is not limited to the description of the above embodiments, and can therefore be modified by a skilled person in the art within the scope of the claims. Namely, an embodiment derived from a proper combination of technical means disclosed in different embodiments is encompassed in the technical scope of the present invention. Moreover, it is possible to obtain a new technical feature from a proper combination of technical means disclosed in different embodiments.

INDUSTRIAL APPLICABILITY

The present invention is applicable to, for example, a cooking device including a magnetron and being to be provided with a radio communication device to function as a network home appliance.

REFERENCE SIGNS LIST

1, 1*a*, 10, 10*a*, 10*b*: cooking device
2: casing
2*a*: heating chamber
3: door (door section)
3*a*: window (window section)
3*b*: frame (frame section)
6, 6*a* through 6*f*: water tank (water reservoir)
8: steam generator
20: radio communication adapter (radio communication device)
50: circuit storing section
M: magnetron

The invention claimed is:

1. A cooking device comprising:

a magnetron:

a heating chamber in which an object to be cooked is to be put;

a door section, provided so that the heating chamber is opened and closed, which has a window section and a nonmetal frame section, which surrounds the window section;

a display operation section configured to carry out display and accept an operation;

a steam generator configured to generate steam; and a water reservoir, mainly made of a nonmetal, which is (i) a container configured to store water to be supplied to the steam generator and (ii) detachably provided from the cooking device, a space for providing a radio communication device that establishes an external communication being secured in contact with the water reservoir.

2. The cooking device as set forth in claim 1, wherein the water reservoir is provided at a lower part of the heating chamber, and the space contacts with the water reservoir at an upper part of the water reservoir and at the lower part of the heating chamber.

3. The cooking device as set forth in claim 1, wherein a circuit storing section, made of a nonmetal, which is configured to store a driving circuit of the display operation section, and the door section are integrally provided.

4. The cooking device as set forth in claim 1, wherein the radio communication device is a device in which a radio communication circuit and an antenna are integrally provided.

5. The cooking device of claim 1 further comprising the radio communication device mounted in the space in contact with the water reservoir.

* * * * *